US006289942B1

(12) United States Patent
Nakada et al.

(10) Patent No.: US 6,289,942 B1
(45) Date of Patent: Sep. 18, 2001

(54) WEFT HOLDER FOR SELVEDGE TUCK-IN DEVICE

(75) Inventors: Akihiko Nakada; Hidetomo Yoneda, both of Kanazawa (JP)

(73) Assignee: Tsudakoma Kogyo Kabushiki Kaisha, Ishikawa-ken (JP)

( * ) Notice: Subject to any disclaimer, the term of this patent is extended or adjusted under 35 U.S.C. 154(b) by 0 days.

(21) Appl. No.: 09/666,105

(22) Filed: Sep. 20, 2000

(30) Foreign Application Priority Data

Sep. 21, 1999 (JP) ..... 11-266866
Apr. 21, 2000 (JP) ..... 12-120306

(51) Int. Cl.[7] ..... D03D 51/00; D03D 47/48; D03D 39/22

(52) U.S. Cl. ..... 139/434

(58) Field of Search ..... 139/434

(56) References Cited

U.S. PATENT DOCUMENTS 4,957,145 * 9/1990 Verclyte et al. ..... 139/434
5,193,591 * 3/1993 Nicolini ..... 139/434
5,718,267 * 2/1998 Kawabata et al. ..... 139/434

FOREIGN PATENT DOCUMENTS 1-148837 6/1989 (JP) .
3-45975 9/1991 (JP) .

* cited by examiner

*Primary Examiner*—Andy Falik
(74) *Attorney, Agent, or Firm*—Wenderoth, Lind & Ponack, L.L.P.

(57) ABSTRACT

A weft holding device transfers a weft to a tuck-in device that tucks and end portion of the weft cut by a weft cutter in a shed formed by warps. The weft holding device has a slit opening backward toward a reed, the warps and the cutter to receive a portion of the weft beaten up by the reed, and a releasing hole connected to the closed end of the slit so as to jet air toward the open end of the slit to move the portion of the weft toward the open end of the slit. Air is jetted through the releasing hole in response to a command signal provided by a loom upon the detection of a mispicked weft to move the mispicked weft to be beaten up backward away from a cutting region in which the weft cutter cuts the weft.

9 Claims, 10 Drawing Sheets

WEFT HOLDER FOR SELVEDGE TUCK-IN DEVICE

BACKGROUND OF THE INVENTION

1. Field of the Invention

The present invention relates to a weft holding device that transfers a weft to a tuck-in device, capable of avoiding cutting a weft with a weft cutter when a command signal is given thereto by a loom controller.

2. Description of the Related Art

A shuttleless loom capable of properly removing a mispicked weft is disclosed in JP-U No. Hei 3-45975. This prior art shuttleless loom is provided with a mispicked weft removing device, a tuck-in device and a tuck-in escaping device. The mispicked weft removing device removes a mispicked weft (improperly picked weft) continuous with a yarn package disposed on the picking end of the shuttleless loom when a weft stop motion operates. The tuck-in device cuts a picked weft at least at a position near the picking end of the loom during a weaving operation and tucks an end portion extending in the picking end in a cloth fell for the next pick to form a tuck selvage. The tuck-in escaping device moves a mispicked weft (improperly picked weft) away from the working position of a tuck-in needle included in the tuck-in device when a weft stop signal is given thereto to avoid tucking an end portion of the faultily picked weft in the selvage.

The tuck-in escaping device of the prior art shuttleless loom has an air nozzle through which compressed air is jetted, and moves a mispicked weft outside of the working region of the tuck-in needle of the tuck-in device by jetting compressed air through the air nozzle against the mispicked weft and, at the same time, avoids cutting the mispicked weft with the weft cutter.

Air jetted through the air nozzle of the tuck-in escaping device diffuses widely, and a large amount of compressed air is necessary to move the mispicked weft effectively. Hence, a large amount of energy is consumed to move the mispicked weft. Since the air nozzle must be disposed near the tuck-in device, a wide selvage is formed unavoidably and, consequently, wefts and a picking fluid are wasted.

SUMMARY OF THE INVENTION

Accordingly, it is an object of the present invention to provide a weft holding device for a tuck-in device disposed adjacent to a weft cutter, capable of surely moving a mispicked weft away from the working region of the weft cutter by a jet of air in response to a command signal given there to by a loom controller when a weft stop motion operates or when necessary and of reducing air consumption.

According to one aspect of the present invention, a weft holding device for a tuck-in device for transferring a weft to the tuck-in device disposed adjacent to a weft cutter that is driven in synchronism with the rotation of a main shaft of a loom in order to tuck an end portion of a picked weft cut by the weft cutter in a shed of warps. The weft holding device comprises a block member provided with a slit for receiving an end portion of the weft beaten up by a reed, opening toward the reed, toward the warps, and toward the weft cutter, and a releasing hole formed in the depth of the slit and opening toward the front of the slit to blow backward the end portion of the picked weft received in the slit. Air is jetted through the releasing hole in response to a command signal provided by the loom to move the end portion of the picked weft away from at least a cutting region in which the adjacent weft cutter operates.

When the command signal is provided by the loom controller, air is jetted through a space defined by upper and lower surfaces defining the slit into the shed so that the jet of air may not diffuse and may act effectively on the picked weft. Consequently, cutting of the picked weft by the weft cutter disposed adjacent to the tuck-in device can be avoided with reliability and only a small amount of air is consumed. An air jetting hole formed in the needleless tuck-in device may be used as the releasing hole to simplify the weft holding device. A mispicked weft can be removed by a low force when the mispicked weft is separated from the cloth fell by jetting air through the releasing hole when the mispicked weft is released from the cloth fell by a mispicked weft removing operation and hence the mispicked weft can be surely removed.

More concretely, air jetted through the releasing hole in response to the command signal provided by the loom controller flows through the space defined by the upper and the lower surface defining the slit toward the shed, the diffusion of the air is suppressed and the air acts effectively on the picked weft. Therefore, cutting of the picked weft yarn by the weft cutter disposed adjacent to the tuck-in device can be prevented with reliability by using a relatively small amount of air. When the air jetting hole of the needleless tuck-in device (air-jet tuck-in device) is used as the releasing hole, any special hole is not necessary and the construction of the weft holding device can be simplified. When the mispicked weft is separated from the cloth fell after the mispicked weft has been released from the cloth fell when the weft stop motion operates or during work for removing a mispicked weft, the mispicked weft can be surely removed by exerting a relatively low force thereto. The present invention is applicable to removing a picked weft yarn when the loom is stopped upon the detection of the breakage of the picked weft and to removing a weft picked in a weaving cycle immediately before warp breakage to prevent the formation of filling bars.

Preferably, the block member provided with the slit is provided with a retaining hole opening into a plane including the slit to retain an end portion of the picked weft by a jet of air acting on the retaining hole.

Since the picked weft tucked up by a jet of air acting on the retaining hole is caught, the picked weft can be surely and securely caught and held by the weft holding device.

Preferably, the releasing hole is formed so as to extend toward the shed and to extend obliquely backward with respect to a direction in which the warps are advanced to form the tuck-in device. Air is jetted through the releasing hole in synchronism with the rotation of the main shaft of the loom to tuck the end portion of the picked weft in the shed after the picked weft has been cut.

Since the releasing hole is formed so as to extend toward the shed and to extend obliquely forward with respect to a direction in which the warps are advanced and the end portion of the picked weft is tucked into the shed by jetting air after cutting the picked weft, any guide hole is not necessary and the block unit is simplified.

Preferably, the command signal provided by the loom is a stop signal that causes the loom to stop and air to be jetted through the releasing hole when the stop signal is provided. The stop signal is, for example, a weft stop signal that is provided when a weft is mispicked.

Since air is jetted through the releasing hole when a stop signal is provided by the loom controller, cutting of the picked weft is prevented when a stop signal is provided.

Preferably, the command signal provided by the loom is a tuck-in inhibition signal to inhibit the execution of a tuck-in operation during the weaving operation of the loom. The weft holding device jets air through the releasing hole when the tuck-in inhibition signal is provided.

Since a weft stop signal is provided as a stop signal when a weft is mispicked, the mispicked weft is not cut and hence work for removing the mispicked weft is facilitated.

Preferably, the tuck-in device is of either a needle type or a needleless type (air-jet type). The releasing hole may be either a hole formed specially for the foregoing purpose or a hole formed for another purpose.

Since the command signal provided by the loom controller is a tuck-in inhibition signal to inhibit the execution of a tuck-in operation during the weaving operation of the loom, cutting of the picked weft can be avoided and weft tuck-in operation can be inhibited.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
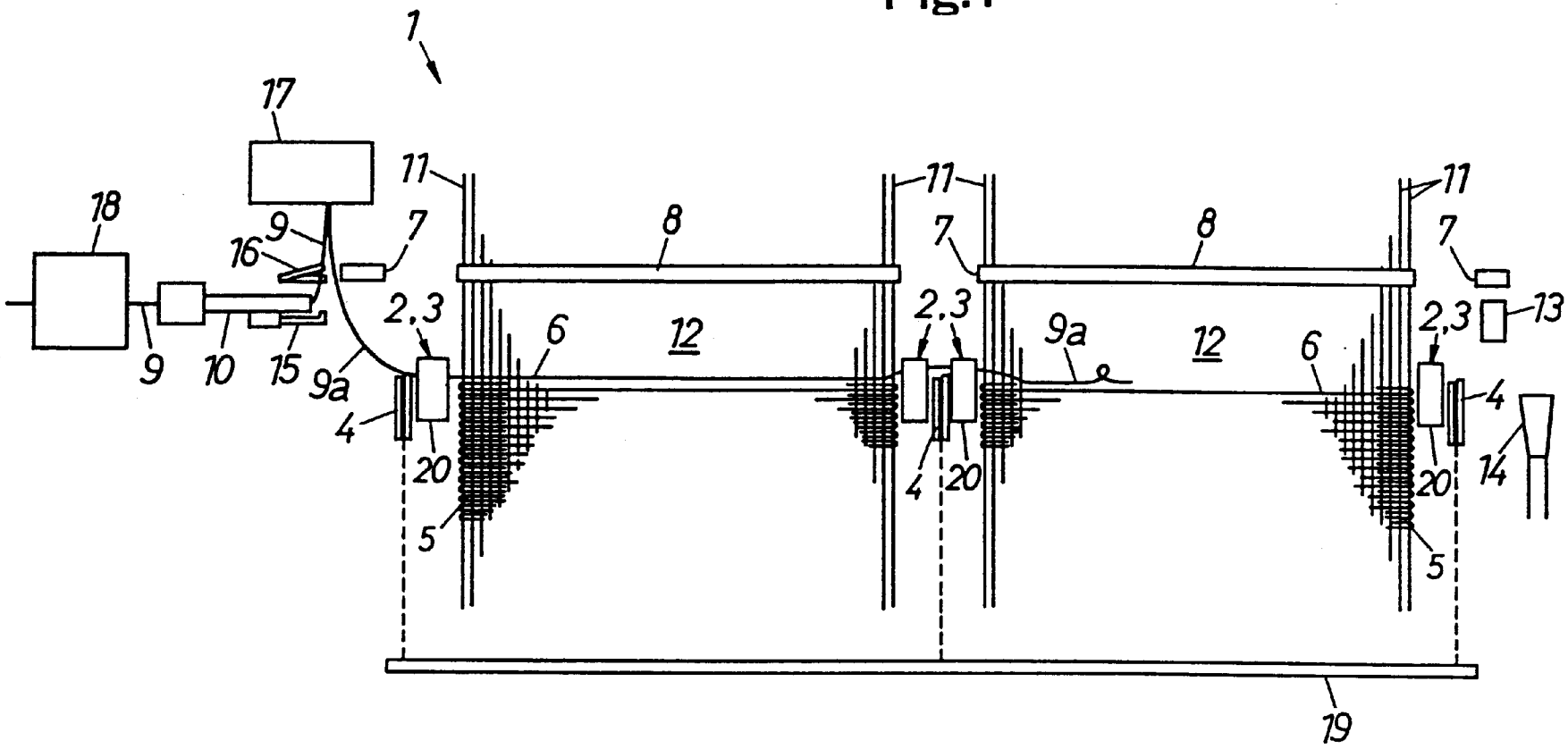
FIG. 1 is a schematic plan view of a multiple-width air-jet loom provided with a needleless (air-jet) tuck-in device, a weft holding device in a preferred embodiment according to the present invention and a mispicked weft removing device.

FIG. 1 shows a double-width (multiple-width) air jet loom 1 provided with four needleless (air jet) tuck-in devices 2, four weft holding devices 3 in a preferred embodiment according to the present invention and three weft cutters 4. Each tuck-in device 2 and each weft holding device 3 is incorporated into one of four block units 20 disposed between an edge of the fabric 5 and the weft cutter 4 disposed near the side edge of the fabric 5 and an extension of the cloth fell 6 of the fabric 5.

The weft cutters 4 are driven mechanically in synchronism with the rotation of the main shaft 19 of the loom 1. The cutting operation of the weft cutters 4 is timed so as to cut a weft 9 after the completion of the beating-up operation of a reed 8. The three weft cutters 4 are disposed at positions on the opposite sides of the loom 1 and a position at the middle of the loom 1. The weft cutter 4 disposed in the picking end of the loom 1 is operated so as to complete the cutting operation before the next picking cycle is started, and the other two weft cutters 4 are operated so that the operation of the tuck-in devices 2 are not obstructed. The reed 8 is provided with openings 7 in sections corresponding to the tuck-in devices 2, the weft holding devices 3 and the weft cutters 4 to avoid interference between the reed 8, and the tuck-in devices 2, the weft holding devices 3 and the weft cutters 4.

A length of the weft 9 for one picking cycle is measured by and stored in a weft measuring and storing device 18 and is picked into a shed 12 of warps 11 by an air jet jetted through a main picking nozzle 10 at picking time. The main picking nozzle 10 is driven together with the reed 8 for swing motions. A normally picked weft 9 is detected by a weft feeler 13 disposed near the arriving end of the loom 1. When the weft feeler 13 detects a free end portion of the weft 9, it determines that the weft 9 has been normally picked. The normally picked weft 9 is beaten up into the cloth fell 6 by the reed 8 and is held by the weft holding devices 3. Then, the cutters 4 cut the weft 9 beaten up into the cloth fells 6 at positions near the weft holding devices 3 to disconnect the picked weft 9 from the weft 9 remaining in the main picking nozzle 10. Thus, separate pieces of the picked weft 9 are held in the cloth fells 6 of the fabrics 5, respectively. End portions of the pieces of the picked weft 9 are held by the weft holding devices 3. A leading end portion of the picked weft yarn cut off from the picked weft 9 held in the cloth fell 6 is sucked by a suction nozzle 14 and is disposed of.

When sheds 12 of the warps 11 are formed for the next picking cycle, the weft holding devices 3 release the pieces of the weft 9 and, at the same time, the tuck-in devices 2 execute a tuck-in operation to jet air through air jetting holes 27 into the sheds 12 so that the free end portions of sections of the picked weft 9 are tucked into the corresponding sheds 12, respectively. The function and construction of the tuck-in devices 2 and the weft holding devices 3 will be described later with reference to FIGS. 2 to 5.

When the weft 9 is not picked normally during the weaving operation in a mispicked weft 9*a*, the weft feeler 13 is unable to detect the leading end portion of the mispicked weft 9*a*. In such a case the weft feeler 13 generates a weft stop signal. Then, the weft holding devices 3 jet air toward the reed 8 to move the mispicked weft 9*a* away from the working regions of the weft cutters 4 to avoid cutting the mispicked weft 9*a* by the weft cutters so that the mispicked weft 9*a* remains continuous with the weft 9 extending in the main picking nozzle 10. A mispicked weft floating nozzle 15 is disposed near the main picking nozzle 10 to separate the mispicked weft 9*a* from the cloth fells 6. A mispicked weft cutter 16 and a mispicked weft removing device 17 are disposed behind the mispicked weft floating nozzle 15.

Figure 2:
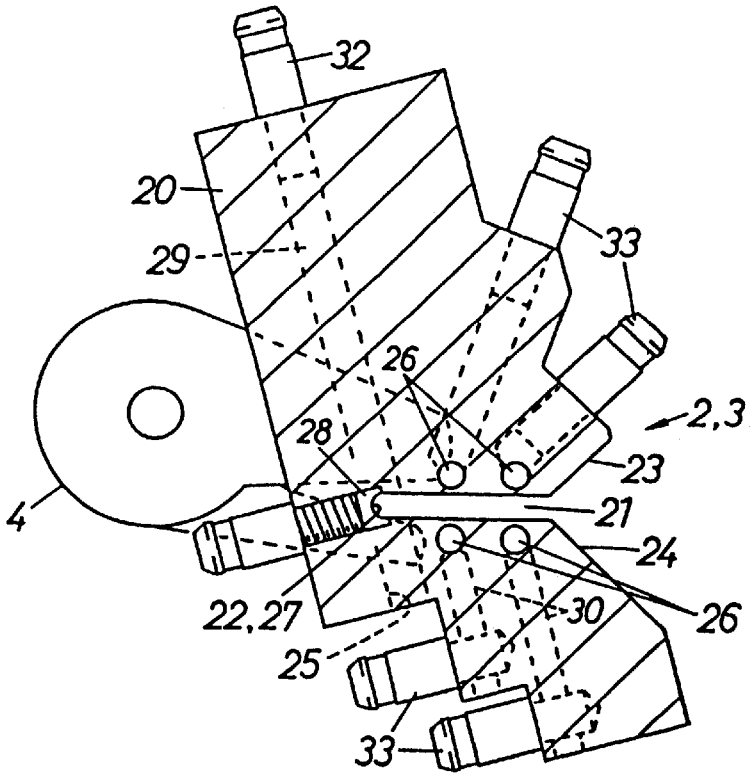
FIG. 2 is a sectional view of the weft holding device embodying the present invention and a weft cutter.
Figure 3:
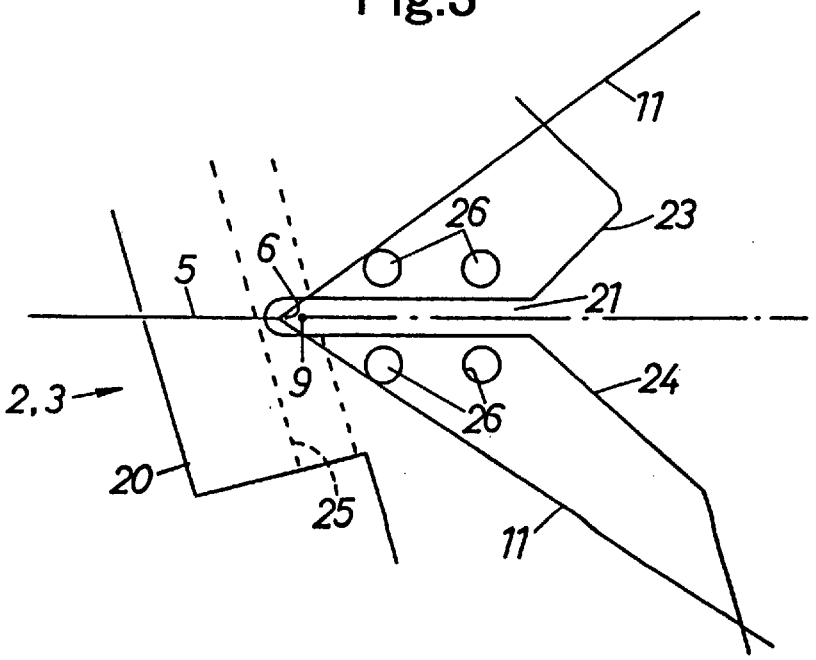
FIG. 3 is an enlarged side elevation of a portion of the weft holding device embodying the present invention provided with a slit.
Figure 4:
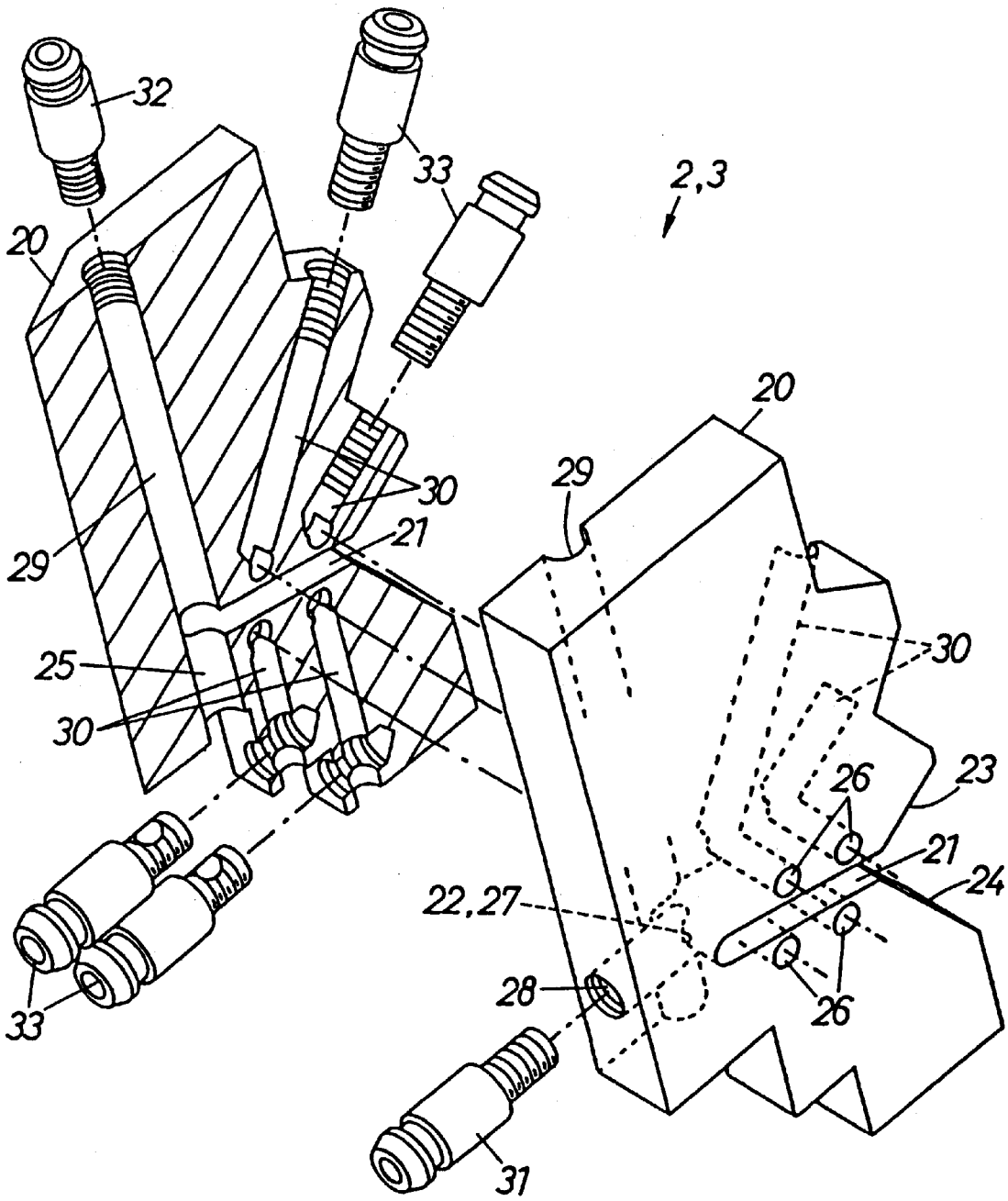
FIG. 4 is a perspective view of an essential part, i.e., a block unit, of the weft holding device embodying the present invention, in which the block unit is cut along a center plane.

FIGS. 2 to 4 show one of the needleless tuck-in devices 2 and one of the weft holding device 3 formed integrally with the tuck-in device 2. The tuck-in device 2 and the weft holding device 3 are formed in the block unit 20. The block unit 20 has a slit 21 opening in three directions, i.e., in directions toward the reed 8, toward the warps 11 and the weft cutter 4, to receive a portion of the beaten-up weft 9, and a releasing hole 22 having the shape of a nozzle hole, connected to the closed end of the slit 21 and opening toward the forward end of the slit 21. Air is blown through the releasing hole 22 to urge a weft 9 caught in the slit 21 toward the forward end of the slit 21.

As shown in FIG. 3, the slit 21 extends along the warps 11 (warp line), and the closed end of the slit 21 is on an extension of the cloth fell 6. The slit 21 and the releasing hole 22 form the weft holding device 3. Inclined guide surfaces 23 and 24 are formed in a forward end part of the slit 21.

The block unit 20 is provided with a streaming hole 27 extending toward the front and connected to the closed end of the slit 21, a retaining hole 25 extending downward, and four guide holes 26 facing the side edge of the fabric 5. In this embodiment, the releasing hole 22 serves also as the streaming hole 27. The releasing hole 22, the retaining hole 25, the guide holes 26 and the streaming hole 27 have the shapes of nozzles, respectively. Nipples 31, 32 and 33 are screwed in ports 28, 29 and 30. The nipples 31, 32 and 33 are connected via on-off valves to a compressed air source, not shown. The guide holes 26 and the streaming hole 27 form the needleless (air jet) tuck-in device 2.

Figure 5A:
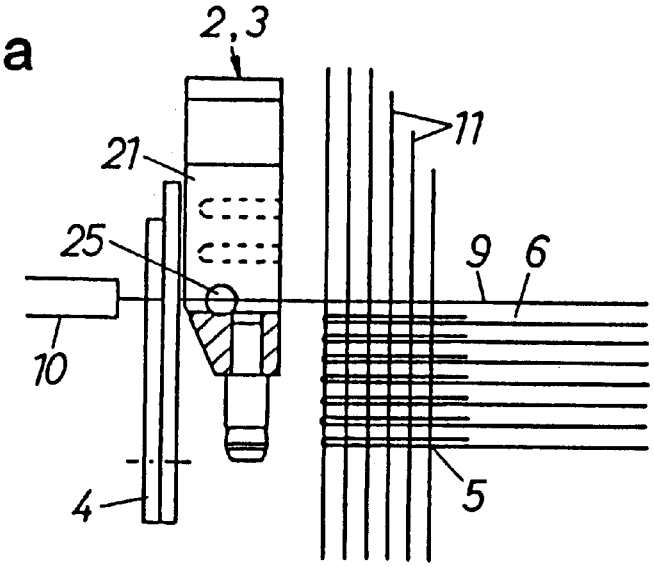
FIGS. 5*a*, 5*b* and 5*c* are schematic plan views of the air-jet loom of assistance in explaining the operation of the tuck-in device.

As shown in FIGS. 3 and 5*a*, a portion of the normally picked weft 9 is moved into the slit 21 as the normally picked weft 9 is beaten up in the cloth fell 6 by the reed 8 and is held in a cutting region in which the weft cutter 4 cuts the weft 9. The portion of the weft 9 moved into the slit 21 is restrained from vertical movement by the upper and the lower surface of the slit 21. The weft cutter 4 cuts the normally picked weft 9 at positions in the cutting regions near the side edges of the fabrics 5 to separate the normally picked weft 9 from the weft 9 remaining in the main picking nozzle 10 and to divide the normally picked weft 9 into sections respectively for the fabrics 5.

Figure 5B:
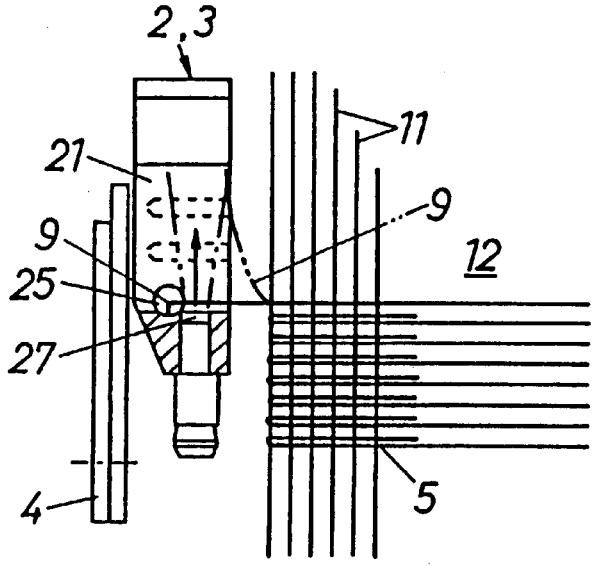

As shown in FIG. 5*b*, the on-off valve, not shown, is opened to supply compressed air from the compressed air source, not shown, through the port 29 to the retaining hole 25 to blow compressed air downward through the retaining hole 25. Consequently, an end portion of the weft 9 extending in the slit 21 is bent in an L-shape and is forced into the retaining hole 25. Thus, the end portion of the weft 9 is retained in the slot 21 and the retaining hole 25 by air jets. The retaining hole 25 restrains the end portion of the weft 9 from forward and backward movement. Thus, the retaining hole 25 functions as the weft holding device 3 in cooperation with the slit 21. The end portion of the weft 9 is restrained from vertical movement by the slit 21, is restrained from forward and backward movement by the retaining hole 25 and is held securely by the weft holding device 3. The on-off valve is closed to stop jetting air through the retaining hole 25 after the shed 12 of the warps 11 has been closed and the picked weft 9 has been interlaced with the warps 11.

Subsequently, a shed 12 of the warps 11 is formed for the next picking cycle. Then, air is jetted backward through the streaming hole 27 as shown in FIG. 5*b* to force the end portion of the weft 9 out of the retaining hole 25 and to stream the end portion of the weft 9 backward through the slit 21.

Figure 5C:
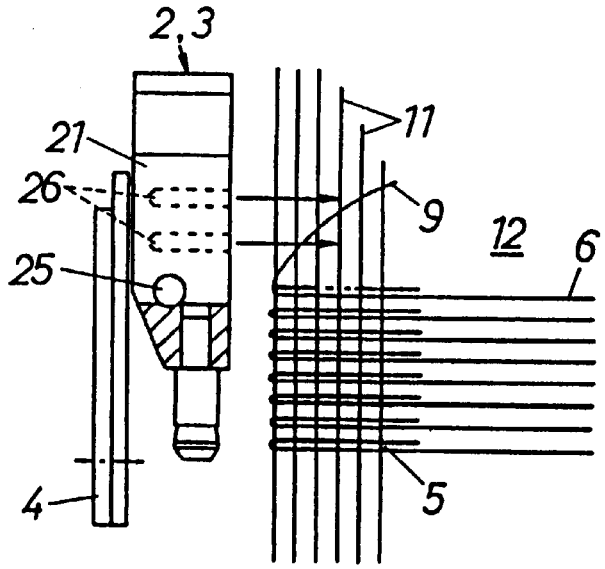

Then, as shown in FIG. 5*c*, air is jetted through the guide holes 26 toward the shed 12 to tuck up the end portion of the weft 9 streamed backward from the cloth fell 6 in a U-shape and to insert the same into the shed 12. Thus, a tuck-in operation is completed. The end portion of the weft 9 tucked in the shed 12 forms a tuck selvage of the fabric 5.

Figure 6:
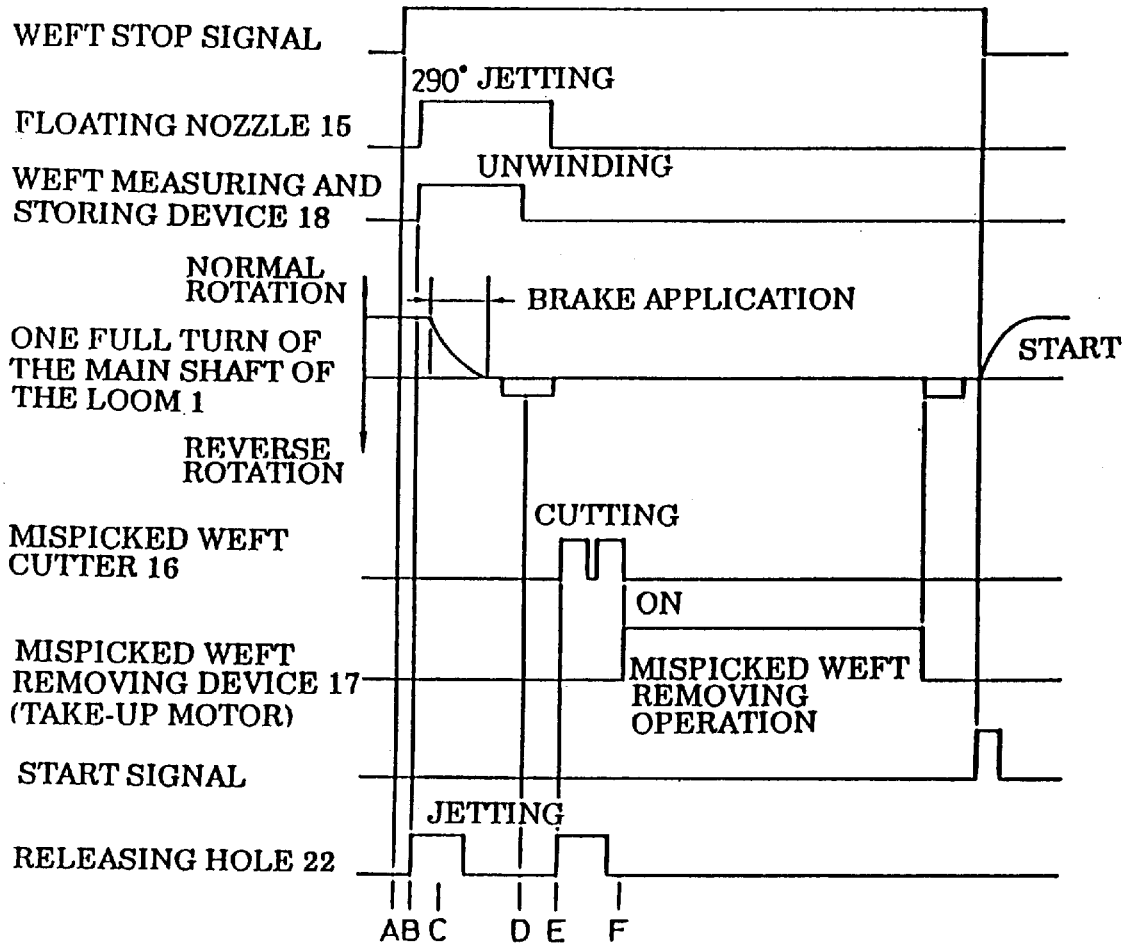
FIG. 6 is a time chart of assistance in explaining a mispicked weft removing procedure.

FIG. 6 is a time chart of a series of operations for removing a mispicked weft 9*a*. FIGS. 7A, 7B, 7C, 8D, 8E and 8F show the states of the middle weft holding device 3 at time points A, B, C, D, E, E and F in FIG. 6, respectively. Sequential operations for a mispicked weft removing procedure will be described with reference to FIG. 6.

The weft feeler 13 generates a weft stop signal when the weft feeler 13 is unable to detect a leading end portion of a picked weft 9 in a predetermined period in each weaving cycle of the loom 1. Then, a loom controller, not shown, decides that mispicking occurred and then the mispicked weft removing procedure for removing a mispicked weft 9*a* is started immediately.

Figure 7A:
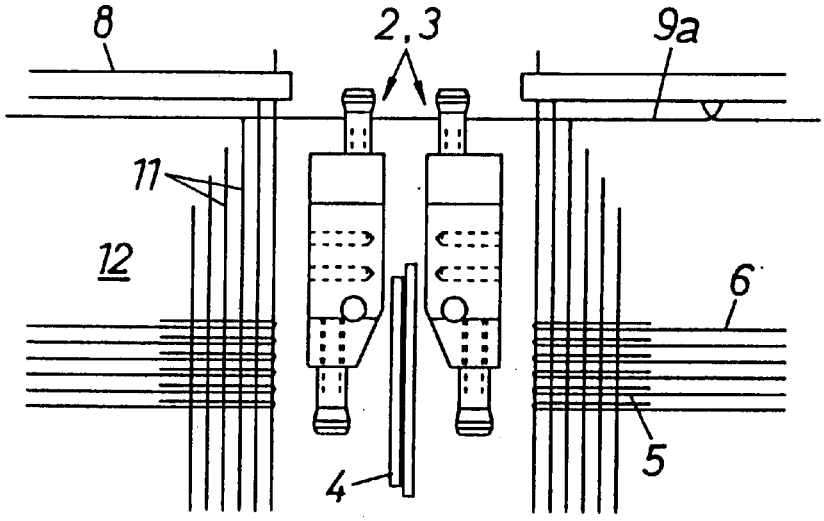
FIGS. 7A, 7B and 7C are schematic plan views of the air-jet loom of assistance in explaining the operation of a middle weft holding device.
Figure 7B:
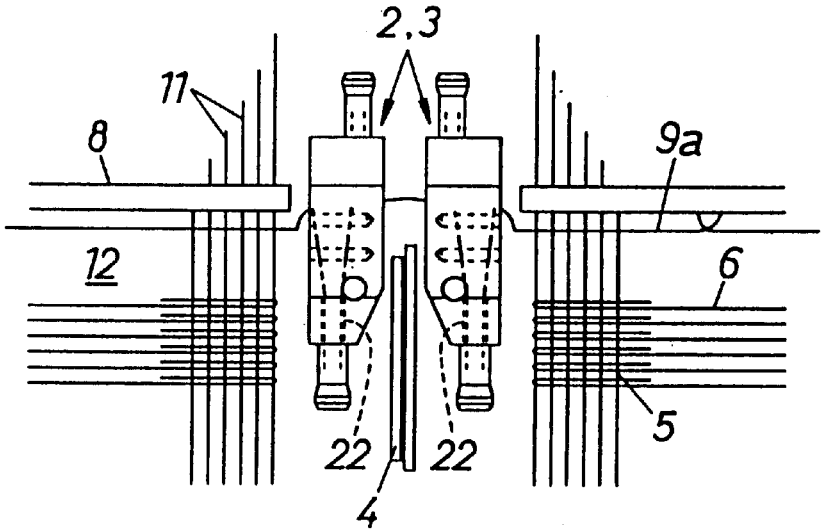

When the weft stop signal is generated in a state shown in FIG. 7A, the loom controller makes the mispicked weft floating nozzle 15 jet air to blow a picked weft 9 toward the mispicked weft removing device 17. At the same time, the loom controller makes the weft measuring and storing device 18 deliver a length of the weft 9 necessary for carrying out the mispicked weft removing procedure, applies a brake, not shown, to start braking the loom, and starts jetting air through the releasing hole 22 for a predetermined period as shown in FIG. 7B.

Figure 7C:
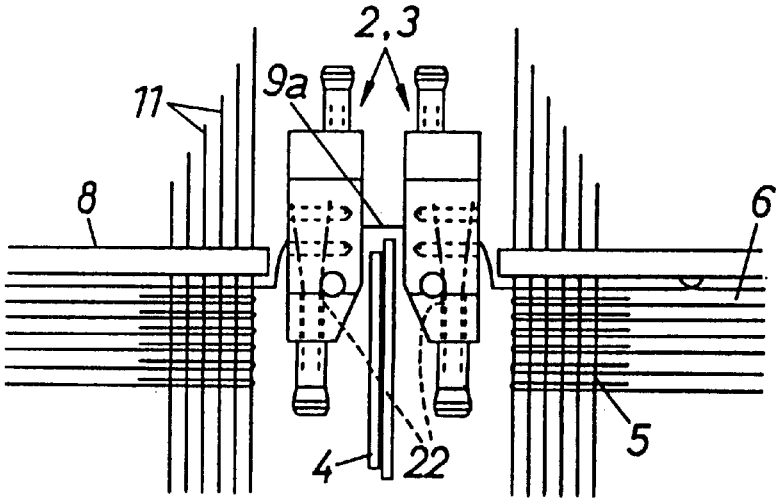

The air jetted through the releasing hole 22 flows from the closed end of the slit 21 backward toward the shed along the guide surfaces 23 and 24 of the slit 21. Therefore the air jetted through the releasing hole 22 does not diffuse and acts effectively on a portion of the mispicked weft 9*a* extending in the slit 21. Consequently, even if the mispicked weft 9*a* is beaten up by the reed 8, the portion of the mispicked weft 9*a* is loosened and is moved backward outside the cutting region in which the weft cutter 4 operates as shown in FIG. 7C. Thus, the mispicked weft 9*a* is not cut by the weft cutter 4. Therefore, even if the weft cutter 4 is actuated in synchronism with the rotation of the main shaft 19 of the loom 1 after the completion of the beating-up operation, the mispicked weft 9*a* is not cut by the weft cutter 4 because the portion of the mispicked weft 9*a* corresponding to the weft cutter 4 is moved outside the cutting region in which the weft cutter operates, and the mispicked weft 9*a* remains continuous with the weft 9 extending in the main picking nozzle 10.

Figure 8D:
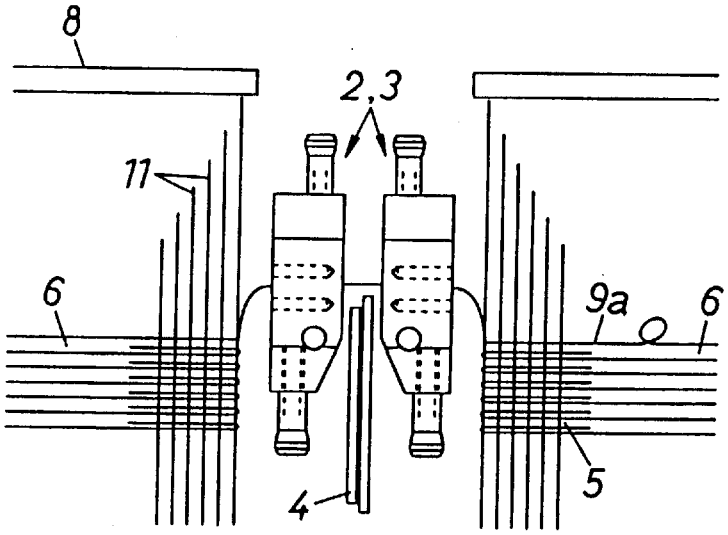
FIGS. 8D, 8E and 8F are schematic views of the air-jet loom in states respectively corresponding to points D, E and F in FIG. 6.
Figure 8E:
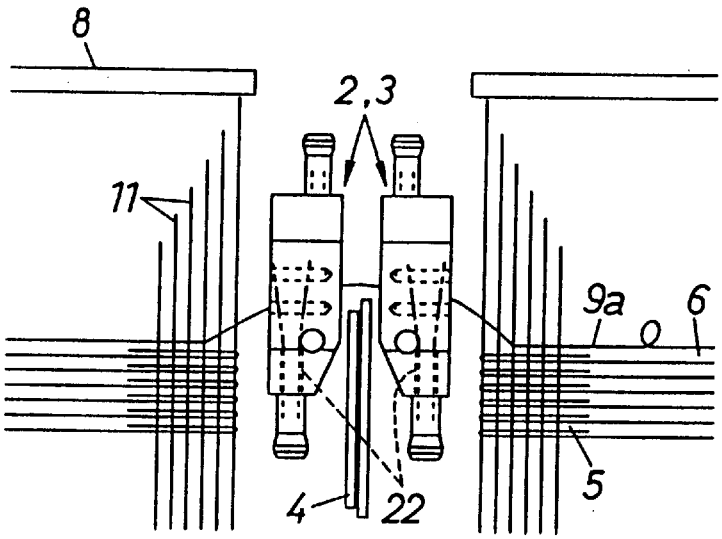

In this state, the mispicked weft 9a can be extracted by the mispicked weft removing device 17 disposed on the picking side. The loom operates for a while for inertial operation and then stops. Then, the loom 1 is reversed for pick finding and the loom is stopped with the mispicked weft 9*a* released from the cloth fell 6 as shown in FIG. 8D.

The weft 9 continuous with the mispicked weft 9*a* is blown up into the mispicked weft removing device 17 together with the mispicked weft 9*a* as shown in FIG. 1 when air is jetted through the mispicked weft floating nozzle 15. In this state, the mispicked weft cutter 16 cuts the weft 9 at a position near the free end of the main picking nozzle 10 to separate the mispicked weft 9*a* from the weft 9 extending in the main picking nozzle 10.

Subsequently, air is jetted, when necessary, through the releasing hole 22 for a predetermined time to separate the mispicked weft 9*a* released from the cloth fell 6 and to stream the mispicked weft 9*a* toward the reed 8. Force exerted by the warps 11 on the mispicked weft 9*a* decreases as the mispicked weft 9*a* is separated from the cloth fell 6 and pulling force necessary for extracting the mispicked weft 9*a* decreases accordingly, so that the possibility of breakage of the mispicked weft when extracting the same can be reduced.

Figure 8F:
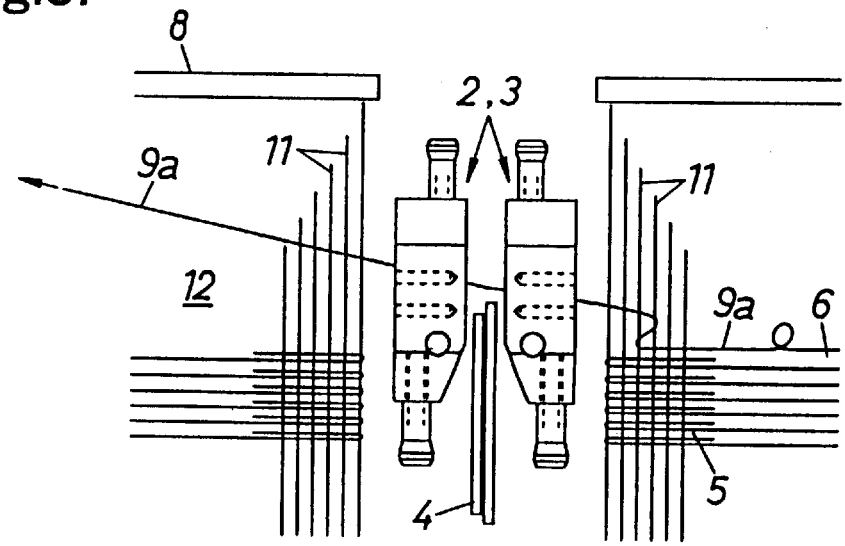

Subsequently, a winding motor included in the mispicked weft removing device 17 is actuated to extract the mispicked weft 9*a* from the shed 12 by taking up the same as shown in FIG. 8F. The removal of the mispicked weft 9*a* is confirmed to complete the mispicked weft removing operation. Then, the loom 1 is reversed to a position corresponding to a starting crank angle suitable for starting the loom 1 and is started when a start signal is given. The weft stop signal is cancelled and the weft feeler 13 is reset.

The pressure and the amount of compressed air to be jetted through the releasing hole 22 is determined beforehand according to the type of the weft 9. The shape of the open end of the releasing hole 22 is not limited to a round shape as shown in the drawings, but may be any suitable shape, such as an oblong shape. The position, the direction and the number of the releasing holes 22 are determined so that the releasing holes 22 are able to exercise an utmost effect. The releasing hole 22 may be used specially for releasing the mispicked weft from the cloth fell instead of using the same also as the streaming hole 27.

Figure 9:
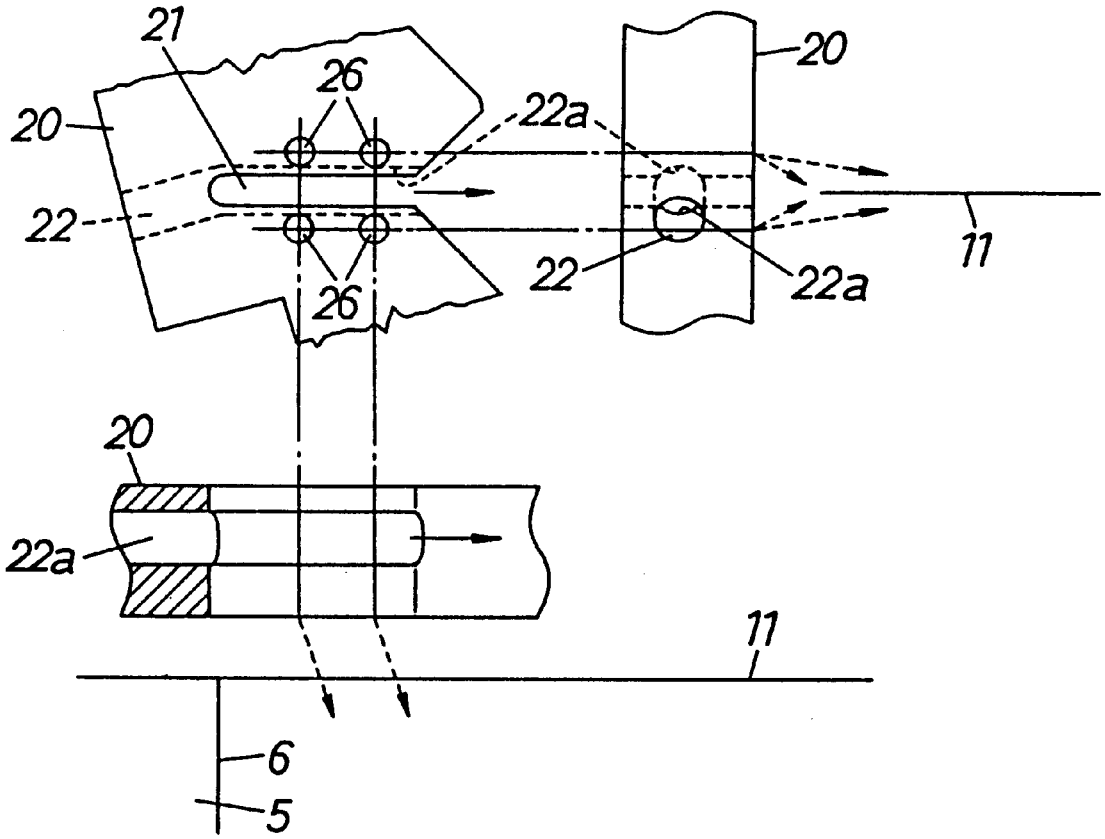
FIG. 9 is a view of a slit in a modification of the slit of the weft holding device embodying the present invention.

As shown in FIG. 9, grooves 22*a* connected to the releasing hole 22 maybe formed in the upper and the lower surface of the slit 21 to jet air in a directional stream. A directional air stream flows at a high velocity and is capable of quickly moving the weft 9, so that the mispicked weft 9*a* can be surely moved out of the cutting region to avoid cutting the mispicked weft 9*a*. Although it is desirable to jet air through the releasing hole 22 in a direction parallel to the warps 11, air may be jetted through the releasing hole 22 in any direction, provided that the air jetted through the releasing hole 22 is capable of avoiding the cutting of the mispicked weft 9*a*. The releasing hole 22 may be formed in any shape and any number of releasing holes 22 may be used, which applies also to the grooves 22*a*. The streaming hole 27 does not need to be formed in parallel to the warps, but may be directed toward a point.

Figure 10A:
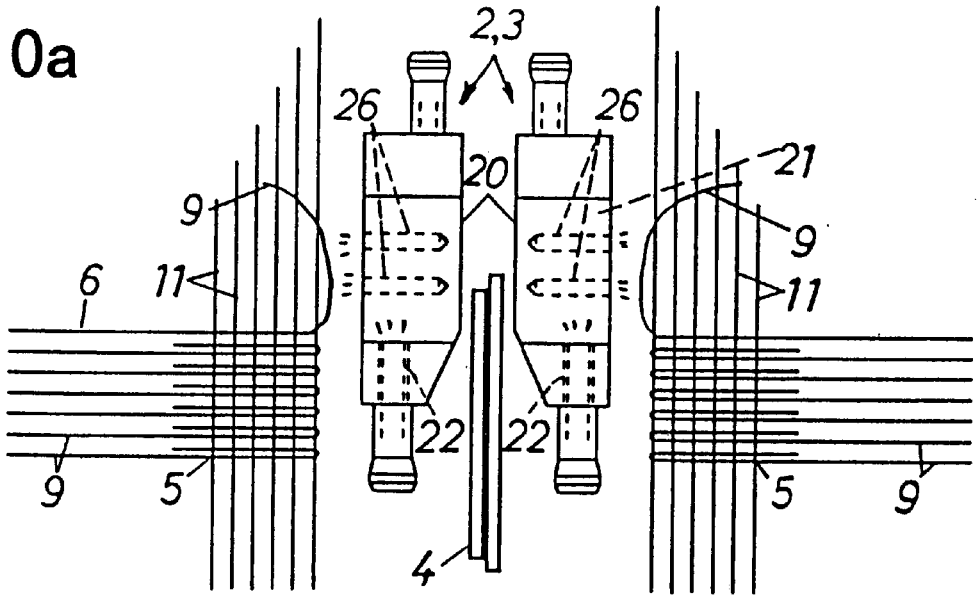
FIGS. 10*a* and 10*b* are schematic plan views of assistance in explaining the operation of a tuck-in device not provided with any retaining hole.
Figure 10B:
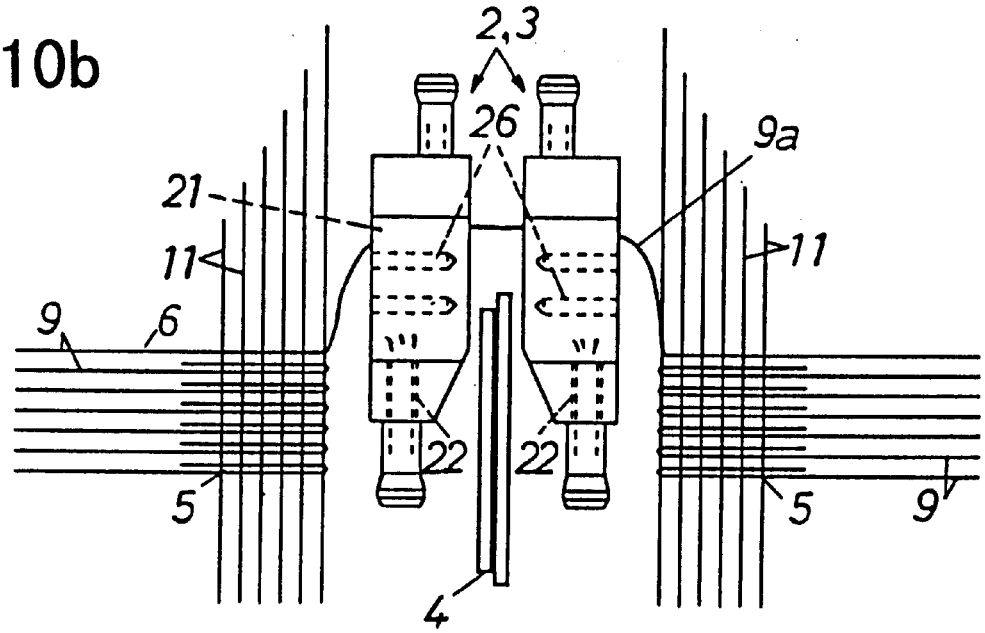

FIGS. 10*a* and 10*b* show weft holding devices 3 not provided with any hole corresponding to the retaining hole 25 for retaining an end portion of the weft 9. As shown in FIG. 10*a*, when tucking in an end portion of a weft 9 while the loom is in the normal weaving operation, the upper and the lower surfaces of a slit 21 restrain the weft 9 from vertical movement until a point in time immediately after the weft 9 has been cut if the cutting operation of a cutter 4 and a tucking operation for tucking up the end portion of the weft 9 (operations for jetting air through the releasing hole 22 and the guide holes 26) are executed simultaneously. Therefore, jets of airjetted for tucking through the releasing hole 22 and the guide holes 26 are exerted effectively on the weft 9. A mispicked weft 9*a* is moved away from a cutting region in which the weft cutter 4 operates to avoid cutting the mispicked weft 9*a* as shown in FIG. 10*b*.

Figure 11A:
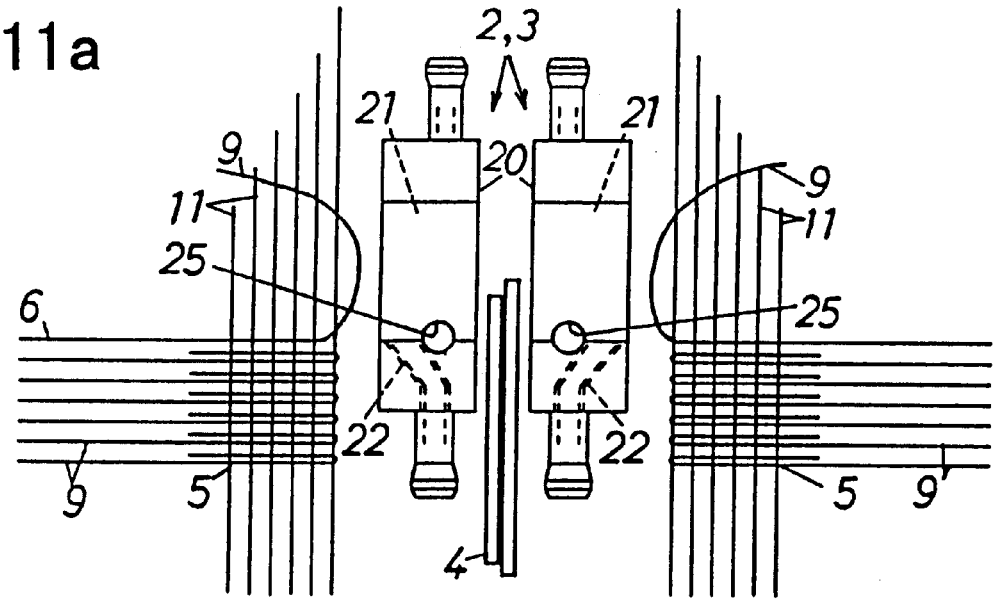
FIGS. 11*a* and 11*b* are views of assistance in explaining the operation of a tuck-in device using a releasing hole as an element thereof.
Figure 11B:
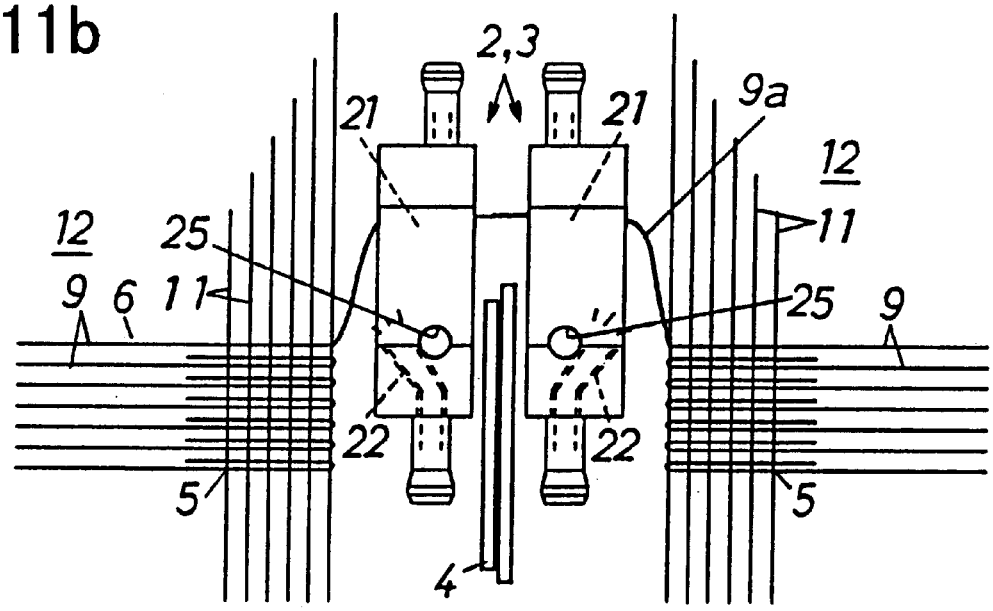

FIGS. 11*a* and 11*b* are views of assistance in explaining the operation of a tuck-in device 2 not provided with any holes corresponding to the guide holes 26. The tuck-in device 2 uses a releasing hole 22 as an element thereof Referring to FIGS. 11*a* and 11*b*, the releasing hole 22 opens into the closed end of a slit 21 and extends obliquely backward and obliquely toward warps 11 so as to jet air into a shed 12 formed by the warps 11. A weft holding devices 3 shown in FIGS. 11*a* and 11*b* are provided with retaining holes 25. The retaining holes 25 maybe omitted.

As shown in FIG. 11*a*, a tuck-in operation is executed during normal weaving operation, in which air is jetted through the releasing hole 22 in synchronism with the rotation of the main shaft 19 of the loom at weft tucking time (time for starting jetting air through the releasing hole 22) to tuck an end portion of the cut weft 9 in a shed 12 of the warps 11. As shown in FIG. 11*b*, a mispicked weft 9*a* is moved away from a cutting region to avoid cutting the mispicked weft 9*a* by jetting air through the releasing hole 22 when the loom 1 provides a weft stop signal or the like. Since the mispicked weft 9*a* is not cut, an end portion of the mispicked weft 9*a* is not tucked in the shed 12 of the warps 11.

Although air supplied through the upper port 29 flows down the releasing hole 25 in the foregoing embodiments, the retaining hole 25 is also able to exercise its weft retaining function even if air is sucked through the lower end of the retaining hole 25. The retaining hole 25 may be formed in the upper or the lower surface of the slit 21 or in the closed end of the slit 21 as long as an end portion of the weft 9 can be retained.

Although the tack-in device 2 in the foregoing embodiment is of a needleless type (air jet type), the weft holding device 3 of the present invention is applicable to a needle type tuck-in device. A weft gripper is used in addition to a needle when a needle type tuck-in device is used. Therefore, the mispicked weft 9*a* must be moved away from a path for the needle so that the mispicked weft 9*a*may not be tucked as well as moving the mispicked weft 9*a* away from the cutting region in which the weft cutter 4 operates. If the mispicked weft 9*a* extends on the path for the needle, the needle hooks the mispicked weft 9*a* without fail and breaks the mispicked weft 9*a*. The mispicked weft 9*a*may be moved away from the path for the needle by either jets of air or the combined effect of jets of air and a mechanical action of a member. The weft gripper is provided with a slit defined by upper and lower guide surfaces parallel to a direction in which the reed is moved for beating-up operation. The weft gripper is advanced to a gripping position to grip a weft 9 after beating-up operation has been completed to hold the weft 9 through a period from the cutting of the weft 9 by the adjacent weft cutter to the hooking of the weft 9 by the needle. When extracting a mispicked weft 9*a*, air is jetted through the releasing hole 22 formed in the closed end of the slit 21 defined by the upper and the lower guide surface to avoid cutting the mispicked weft 9*a*. This is applicable not only to the middle tuck-in devices disposed between the fabrics but also to the tuck-in devices disposed near the opposite ends of the loom.

When removing a mispicked weft, air is jetted through the releasing hole 22 of the weft holding device 3 when a weft stop signal is provided to prevent cutting the mispicked weft in the foregoing embodiments. Cutting of the mispicked weft can be avoided by using a signal provided by the loom other than the weft stop signal as a command signal. Although the weft stop signal is obtained by the weft feeler 13 for detecting a short pick (mis-pick) in the foregoing explanation, it can be obtained by utilizing a signal outputted by the weft feeler 13 for detecting a broken pick. The weft feeler 13 for detecting the broken pick is disposed at a position beyond the weft feeler 13 for detecting the short pick (mis-pick). A warp stop signal may be used instead of the weft stop signal as a signal to stop the loom. When one or two wefts previously woven into the fabric need to be removed before restarting the loom to prevent filling bars that may be formed when the loom is stopped and restarted, the previously woven wefts can be easily removed because the previously woven wefts are not cut and not tucked in and can be extracted in a single weft. Therefore, the signal may be a signal provided when a warp, a selvage forming yarn or a catch cord is broken to stop the loom or a stop signal provided when the operator decides that the loom must be stopped and operates a push-button switch.

The weft cutting operation can be inhibited by a weft tucking-in inhibit signal provided during the weaving operation of the loom 1. Generally, as mentioned in Japanese Patent No. 2501845, when weaving a pile fabric, such as a three-weft towel, the tuck-in operation is inhibited in a weaving cycle for forming one pile including three picking cycles until a pile forming picking cycle is executed, and all the picked wefts are tucked in simultaneously in the next picking cycle subsequent to the formation of the pile. According to this technique, when the wefts picked in the two picking cycles in which tucking-in operation is not executed are cut by the adjacent weft cutter, end portions of the cut wefts must be held until the same are tucked in. If a tucking-in inhibit signal is generated in a period in which at least a beating-up operation and a weft cutting operation are carried out in the picking cycles in which the tucking-in operation is not carried out and air is jetted through the releasing hole in response to the tucking-in inhibit signal, the consumption of air can be suppressed, cutting of the weft can be surely avoided, any complicated device for holding the end portions of the weft during the picking cycles in which tucking-in is not performed is not necessary, and the construction can be simplified. A mispicked weft may be removed by any suitable device other than the foregoing mispicked weft removing device. The mispicked weft removing device may be moved near to the main picking nozzle to catch the mispicked weft or the mispicked weft removing device may be disposed on the arriving side opposite the picking side.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. A loom comprising:

a main shaft;

a weft cutter arranged so as to be driven in synchronism with a rotation of said main shaft and for cutting a picked weft;

a tuck-in device for tucking an end portion of the picked weft cut by said weft cutter into a shed of warps;

a weft holding device for retaining the picked weft and transferring the picked weft cut by said weft cutter to said tuck-in device, said weft holding device comprising a block member having a slit for receiving an end portion of the picked weft beaten up by a reed, said slit opening toward the reed, toward the warps, and toward said weft cutter, said weft holding device including a releasing hole at a closed end of said slit and directed toward an open end of said slit such that a jet of air through said releasing hole can blow the end portion of the picked weft received in said slit toward said open end of said slit; and a loom controller for controlling the jet of air to be jetted through said releasing hole so as move the end portion of the picked weft received in said slit away from a cutting region of said weft cutter.

2. The loom of claim 1, wherein said weft holding device and said tuck-in device are formed as an integral unit.

3. The loom of claim 1, wherein said block member has a retaining hole opening into a plane of said slit so as to retain the end portion of the picked weft by a jet of air flowing through said retaining hole.

4. The loom of claim 3, wherein said releasing hole has at least a portion formed so as to extend obliquely toward the shed with respect to a direction of advancement of the warps, said tuck-in device comprising said obliquely-extending portion of said releasing hole, wherein said loom controller controls the jet of air to be jetted through said releasing hole in synchronism with the rotation of said main shaft so as to tuck the end portion of the picked weft.

5. The loom of claim 1, wherein said releasing hole has at least a portion formed so as to extend obliquely toward the shed with respect to a direction of advancement of the warps, said tuck-in device comprising said obliquely-extending portion of said releasing hole, wherein said loom controller controls the jet of air to be jetted through said releasing hole in synchronism with the rotation of said main shaft so as to tuck the end portion of the picked weft.

6. The loom of claim 1, wherein said loom controller is adapted to generate a stop signal for controlling the jet of air to be jetted through said releasing hole and for simultaneously causing an operation of the loom to stop.

7. The loom of claim 6, wherein the stop signal is a weft stop signal generated when a weft is mispicked.

8. The loom of claim 7, further comprising a weft feeler connected to said loom controller and adapted to detect a leading end of a weft so as to determine if the weft is a picked weft or a mispicked weft, wherein the weft stop signal is generated by said loom controller if said weft feeler determines that the weft is a mispicked weft.

9. The loom of claim 1, wherein said loom controller is adapted to generate a tuck-in inhibition signal for preventing a tuck-in operation during a weaving operation of the loom and for simultaneously controlling the jet of air through said releasing hole.

* * * * *